US011473885B2

(12) United States Patent
Spinelli et al.

(10) Patent No.: US 11,473,885 B2
(45) Date of Patent: Oct. 18, 2022

(54) LIGHTWEIGHT HIGH SPECIFIC MODULUS AND HIGH SPECIFIC STRENGTH COMPONENTS FOR USE IN MISSILE INTERCEPTORS AND KILL VEHICLE

(71) Applicant: Omnitek Partners LLC, Ronkonkoma, NY (US)

(72) Inventors: Thomas Spinelli, Northport, NY (US); Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 16/404,691

(22) Filed: May 6, 2019

(65) Prior Publication Data

US 2020/0400413 A1 Dec. 24, 2020

Related U.S. Application Data

(60) Provisional application No. 62/668,184, filed on May 7, 2018.

(51) Int. Cl.

| | |
|---|---|
| ***F41H 11/02*** | (2006.01) |
| ***F42B 12/20*** | (2006.01) |
| ***F42B 15/00*** | (2006.01) |
| ***F42B 12/02*** | (2006.01) |
| *F42C 15/00* | (2006.01) |

(52) U.S. Cl.

CPC ..... *F42B 12/207* (2013.01); *F41H 11/02* (2013.01); *F42B 12/02* (2013.01); *F42B 12/205* (2013.01); *F42B 12/208* (2013.01); *F42C 15/00* (2013.01)

(58) Field of Classification Search

CPC ..... F42B 12/00; F42B 12/02; F42B 12/20; F42B 12/201; F42B 12/204; F42B 12/205; F42B 12/207; F42B 15/00; F42B 15/01; F42B 15/08; F42B 15/10; F42B 15/105; F42B 15/12; F41H 11/02

USPC ..... 102/473, 501, 517, 518, 519

See application file for complete search history.

(56) References Cited

U.S. PATENT DOCUMENTS 6,054,197 A * 4/2000 Rastegar ..... F16F 1/00 428/218
6,082,072 A * 7/2000 Rastegar ..... F16F 1/00 52/167.3
6,112,410 A * 9/2000 Rastegar ..... E04C 3/29 29/897.3

(Continued)

*Primary Examiner* — James S Bergin

(57) ABSTRACT

A compressive structural element including: an enclosure having a top, a bottom, and inner wall and an outer wall, a first cavity defined between the inner and outer walls and a second cavity defined by the inner wall; and a non-compressible material disposed in the first cavity; wherein the outer wall has at least a portion thereof inwardly shaped toward the first cavity and the inner wall has at least a portion outwardly shaped towards the first cavity such that a first compressive force acting on the top and/or bottom tending to compress the element by a first deflection causes an amplified second deflection, relative to the first deflection, of the inner and/or outer walls into the non-compressible material, thereby exerting a second compressive force against the non-compressible material, resulting in a resistance to the first deflection and the first compressive force tending to compress the element.

11 Claims, 18 Drawing Sheets

(56) References Cited

U.S. PATENT DOCUMENTS

| | | | | |
|---|---|---|---|---|
| 6,370,833 | B1 * | 4/2002 | Rastegar | E04C 3/29 52/837 |
| 6,474,039 | B2 * | 11/2002 | Rastegar | F16F 1/00 52/838 |
| 6,575,715 | B1 * | 6/2003 | Rastegar | F16F 1/00 417/480 |
| 6,684,596 | B2 * | 2/2004 | Rastegar | E04C 3/29 52/837 |
| 6,939,618 | B2 * | 9/2005 | Rastegar | E04C 3/29 417/480 |
| 6,990,885 | B2 * | 1/2006 | Boyd | F42B 15/12 244/3.1 |
| 7,494,090 | B2 * | 2/2009 | Leal | F42B 12/58 244/3.17 |
| 8,371,201 | B2 * | 2/2013 | Deflumere | F41G 7/2293 89/1.11 |

* cited by examiner

LIGHTWEIGHT HIGH SPECIFIC MODULUS AND HIGH SPECIFIC STRENGTH COMPONENTS FOR USE IN MISSILE INTERCEPTORS AND KILL VEHICLE

CROSS-REFERENCE TO RELATED APPLICATION

This application claims the benefit of earlier U.S. Provisional Application No. 62/668,184, filed on May 7, 2018, the entire contents thereof being incorporated herein by reference.

The present application is related to U.S. Pat. Nos. 6,054,197; 6,082,072; 6,112,410; 6,370,833; 6,474,039; 6,575,715; 6,684,596 and 6,939,618, the entire contents of each of which is incorporated herein by reference.

BACKGROUND

1. Field

The present invention relates generally to missile interceptors and kill vehicles and more particularly to lightweight high specific modulus and high specific strength components for use in missile interceptors and kill vehicles.

2. Prior Art

The basic function of a missile defense system is to use ballistic missiles to shoot down a threat target, such as, an incoming ICBM. ICBM launches have three distinct phases of flight. During the boost phase, a rocket launches the warhead at high speeds above the atmosphere, where it continues in free-fall through the vacuum of space. The midcourse phase begins with the rocket separating from the warhead, which continues unguided and unpowered, hundreds of miles above the Earth. The reentry, or terminal, phase sees the warhead descend at high speeds back through the Earth's atmosphere toward the ground.

Current ground-based midcourse defense (GMD) systems can be summarized as follows:

1. The threat missile is launched.
2. Satellites using infrared technology and radar detect the launch and track the missile's trajectory.
3. The threat missile releases a warhead and decoys (the "threat cloud").
4. Ground-based and sea-based radar continuously track the threat cloud, trying to distinguish and identify the warhead from the decoys.
5. The missile defense system launches an interceptor missile. The interceptor missile consists of a three-stage booster rocket (used in succession), and a "kill vehicle," which travels alone after the last booster separates.
6. The interceptor's payload, the "kill vehicle," separates from the missile body.
7. Using intercept data, the kill vehicle is guided toward an intercept point, where it views the target using its own sensors. From there, using small thrusters to adjust its direction, the interceptor is steered in an attempt to track and collide with the incoming warhead. The kill vehicle spots the threat cloud and attempts to intercept the warhead high above in the atmosphere. Earlier forms of missile defense used explosives, while current GMD systems relies solely on collision.

The objective of the GMD system is to destroy the threat target in space before it can reach its ground target. These systems differ, however, from terminal-phase within-the-atmosphere missile defense systems.

Although the underlying concepts are simple, the reality of GMD systems is that they are very complex, expensive, and mired with technical difficulties that may lend potential adversaries with a tactical advantage.

Such difficulties include countermeasures used to disrupt or undermine the GMD system. For example, lightweight decoys can be employed to confuse interceptor sensors. Because objects of different weights follow the same trajectory in space, releasing decoys during the midcourse phase can prevent interceptor missiles from accurately identifying the warhead. This could force the missile defense system to try to destroy all of the incoming projectiles, exhausting the limited supply of interceptors. Another countermeasure may include the use of cooled shrouds to lower a warhead's temperature, rendering it either invisible to interceptor missiles (which use infrared sensors), or reducing the interceptor's ability to detect the warhead quickly enough.

In addition, since kill vehicles rely solely on kinetic energy to destroy an incoming ICBM, such kinetic energy must be maximized in order to destroy a much larger and massive ICBM. However, many components necessary for operation of the kill vehicle have an inherently low rigid mass thereby lowering the overall specific modulus and specific strength of the kill vehicle. Thus, developing kill vehicles which maximize rigid mass is critical to successfully neutralizing a threat target, such as an ICBM. Furthermore, the rigidity of the kill vehicle and its components must be in the direction of the Kill vehicle's travel.

Furthermore, current kill vehicles are very large and expensive, therefore, the requirement to use many of them to neutralize all objects in a threat cloud may be unrealistic. On the other hand, smaller size kill vehicles may be less expensive and less complicated and consequently, may provide a greater probability of success against a threat cloud, however, the rigid mass of such smaller kill vehicles may not be great enough to adequately destroy the threat target(s), even with a direct strike.

Still further, the current generation of kill vehicles rely solely on kinetic energy to destroy an incoming ICBM because the addition of explosives on board the kill vehicle does not add to the kill vehicles rigid mass and can be replaced with rigid components. This may be particularly problem some with smaller sized kill vehicles which need to maximize rigid mass more so than larger sized kill vehicles. Development of an explosive component to a smaller size kill vehicle where such explosive component has a rigid mass having high specific modulus and specific strength may greatly increase a likelihood of destroying an incoming target threat where there is a direct hit or even for an indirect, glancing strike.

Structural elements having various configurations which provide high rigidity against a load tending to deform such structural element are known (see U.S. Pat. Nos. 6,054,197; 6,082,072; 6,112,410; 6,370,833; 6,474,039; 6,575,715; 6,684,596 and 6,939,618). Although such structural elements have rigidity under compressive, tensile and a combination of compressive and tension forces, only those configured to provide rigidity under compressive forces are discussed herein. Such structural elements are highly rigid and lightweight and can be configured to become increasingly rigid as the deforming force increases.

Referring to FIGS. 1-3, there is illustrated a compressive structural element 100. The compressive structural element 100 includes one or more walls 108 comprising a plurality of panels 102 separated by flexural joints 104 to define a cavity 106. The flexural joints 104 can be "in-turned" portions running longitudinally to the structural element's height. Also, the wall 108, top 110, and bottom 112 can comprise an integral metal shell. However, any suitable material can be utilized and the shell can be made in components and assembled together.

Disposed in the cavity is a non-compressible material 114. The non-compressible material 114 can be an elastomer, a liquid, a gel or any combination thereof. The walls 108 are shaped such that a first compressive force F, shown in FIG. 3, tends to compress the structural element by a first deflection d1 which causes an amplified second deflection d2 of the walls into the non-compressible material 114. The relaxed position of the compressive structural element 100 (i.e., where no compressive force is present) is shown in FIG. 3 as dashed lines. With the application of the first compressive force F, the walls 108 (102) thereupon exert a second compressive force C against the non-compressible material 114 disposed in the cavity 106. Being non-compressible, the non-compressible material 114, resists the second compressive force C with a resistive force R resulting in a resistance to the first deflection d1 and the first compressive force F.

In order to optimize the amplification of the second deflection d2 into the non-compressible material 114, the walls 108 (102) are concavely shaped into the cavity 106. Furthermore, the walls 108 can be configured to provide optimum rigidity depending upon the application. For instance, as shown in FIG. 3, the walls 108 can be of uniform thickness where the end portions are of substantially the same thickness as the center portion. This configuration causes minimal migration of the non-compressible material due to the second compressive force F2 resulting in a lightweight compressive structural element 100 which provides high rigidity.

SUMMARY

It is therefore desirable to develop smaller, less costly and complicated kill vehicles having a high rigid mass to successfully neutralize all potential threat targets contained in a threat cloud.

Embodiments of lightweight high specific modulus and high specific strength components for use in missile interceptors and kill vehicles are provided. Such "rigid mass components" for missile interceptors and kill vehicles that are lightweight also are associated with low-cost manufacturing processes for producing the same. Such lightweight "rigid mass components" are rigid in the direction of flight of the interceptor missile or kill vehicle.

The "rigid mass components" can contain and house components necessary for operation of the missile interceptor and kill vehicle which do not ordinarily add to the rigid mass of the missile interceptor and kill vehicle and use such components to aid in increasing the missile's or kill vehicle's specific modulus and specific strength. Examples of such components provided with high specific modulus and high specific strength are electronics, steering actuators, fuel, batteries and even the casing of the missile interceptor or kill vehicle itself. Furthermore, although kill vehicles mostly rely on kinetic energy to destroy a threat target, explosives (which normally do not achieve the objective of having "rigid mass"), can be provided as a component having high specific modulus and high specific strength using the devices and methods disclosed herein, thereby providing an added degree of success where the missile or kill vehicle fails to directly strike the threat target or strikes the threat target without sufficient kinetic energy to neutralize the same.

In addition to providing high specific modulus and high specific strength components for use in interceptor missile and kill vehicles, also provided is the use of rigid mass components that deploy from a forward surface of the interceptor missile or kill vehicle to increase a frontal impact area of the interceptor missile or kill vehicle, thereby increasing the probability of a direct strike on the threat target. Such devices not only deploy the components from the forward surface of the interceptor missile and kill vehicle but can also provide the additional frontal impact area with a high specific modulus and high specific strength so that such components can increase the probability of impact with the threat target due to their increased frontal area and do so with a rigid mass component to further increase the probability of neutralizing the threat target.

Although the "rigid mass components" disclosed herein are those that typically reduce and compromise the overall rigidity of kill vehicles and missile interceptors, the devices and methods disclosed herein are equally applicable to other missile interceptor and kill vehicle components, such as seeker baffles, bulkheads, protective coverings, shielding and interfaces.

Although the devices and methods discussed herein are applicable to both missile interceptors and kill vehicles, such methods and devices will be discussed below only with regard to kill vehicles used to destroy a threat target in a mid-course phase of a threat target (e.g., ICBM), without limiting the applicability thereof.

In this proposal, the following embodiments are disclosed:

1. "Rigid mass components" for use in kill vehicles that "rigidizes" components, necessary for operation of the kill vehicle, that normally do not add to the "rigid-mass" of the kill vehicle. Such components add "rigid mass" in a lightweight manner, with cost-effective manufacturing processes where the rigidity can be in a direction of travel of the kill vehicle.

"Rigid mass components" for use in kill vehicles that deploy from a frontal impact area of the kill vehicle, thereby both enlarging and "rigidizing" such frontal impact area in a direction of travel of the kill vehicle to increase the probability of a direct strike on the threat target and the probability of neutralizing the threat target.

The embodiments of "rigid mass components" provide kill vehicles with an overall high specific modulus and high specific strength and/or to increase a frontal area of the kill vehicle in a rigid mass manner to increase the likelihood of neutralizing a threat target, such as an ICBM. This includes providing high specific modulus and high specific strength for those components that typically reduce and compromise the rigid mass of a kill vehicle, such as electronics, batteries, actuators and fuel, and will provide such rigid mass in the direction of travel of the kill vehicle, i.e., in a direction of impact with the threat target. Still further, the rigid mass components can be in the form of explosives having high specific modulus and high specific strength.

The embodiments of "rigid mass components," are described in detail below, namely, (i) those housing components that typically reduce and compromise the overall rigid mass of a kill vehicle in a structural element having high specific modulus and high specific strength and (ii) those increasing a frontal area of a kill vehicle in a rigid manner.

BRIEF DESCRIPTION OF THE DRAWINGS

These and other features, aspects, and advantages of the apparatus of the present invention will become better understood with regard to the following description, appended claims, and accompanying drawings where:

FIG. 1 is a side view of the structural element and FIGS. 2 and 3 illustrated sectional view of the structural element of FIG. 1 as taken along line 2-2 and 3-3, respectively.

DETAILED DESCRIPTION

The first embodiments of lightweight and inexpensive "rigid mass components" for use in kill vehicles utilize both the basic design of the structural elements described above as well as modifications of such structural elements having particular utility for certain kill vehicle components. A first type of such "rigid mass components" are those housing components that typically reduce and compromise the overall rigid mass of a kill vehicle, in a structural element having high specific modulus and high specific strength.

A second type of "rigid mass components" for use in kill vehicles are for increasing a frontal area of a kill vehicle, which not only increase a frontal impact area of the kill vehicle, but do so in a rigid manner and in a direction of travel/impact of the kill vehicle.

The first type of "rigid mass components" are variations based on the basic design of the structural elements described above. These structural elements can provide high rigidity while being relatively light weight. In addition, such structural elements can be modified to house kill vehicle components that typically compromise the rigidity of a kill vehicle, such as electronics, batteries, actuators, fuel and explosives. The casing itself may also be formed of a modified structural element to house other structural elements containing the kill vehicle components.

A first variation of the structural elements described above either (i) embeds typical kill vehicle components in a non-compressible elastomer, gel or liquid in the interior cavity of the structural element, (ii) uses all or a portion of the kill vehicle component as the non-compressible material of the structural element or (iii) where the design of the structural element is modified from those discussed above so as to have an empty internal volume that can be occupied by a kill vehicle component.

Figure 4:
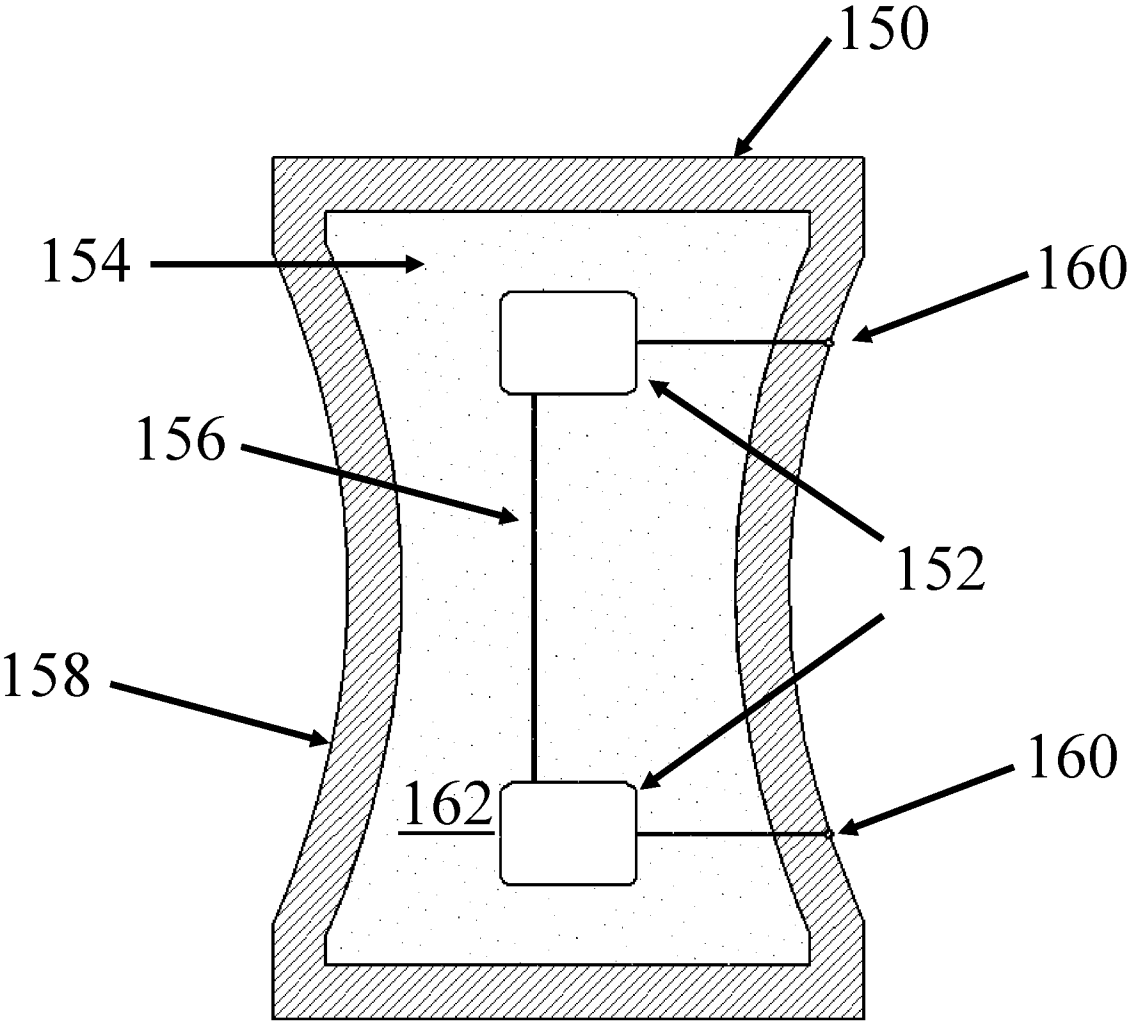
FIG. 4 illustrates a sectional view of a rigid mass component for a kill vehicle in the form of a housing for electronic components.

With respect to the first variation where typical kill vehicle components are embedded in a non-compressible elastomer, gel or liquid in the interior cavity of the structural element, a first embodiment is illustrated in FIG. 4 where the component can be on board electronics. FIG. 4 shows a structural element 150 as described above having electronic components 152 potted in a non-compressible material 154, such as an elastomer. Electrical wiring 156 can be provided between components as well as to the outside of the structural element, in the form of leads 160 for connection to other components or to a power supply (discussed below). The number and function of the electronic components 152 can vary from a single component that is part of a larger circuit or to several electronic components of a complete circuit for performing a particular function.

The electronic components can be positioned away from the middle of the interior cavity 162 where the deflection of the walls 158 inward is greatest to avoid any potential damage to the electronic components 152. The wall configuration can be formed to minimize compression of the electronic components 152 and well as fortifying the electronic components 152 against such compression. Further, different non-compressible materials 154 can be provided for embedding the electronic components 152 and at the central region of the interior cavity 162 minimizes any negative effects on the electronic components 152 without reducing or significantly reducing the rigidity of the structural element 150.

As will be discussed below, such structural elements 150 can be stacked within the casing of the kill vehicle such that they are oriented to provide rigidity in a direction of the kill vehicle's travel. In such configuration, electrical connections between electronic components in different structural elements can be provided as conventional wiring harnesses or the casing itself can provide the electrical connection between different structural elements having electrical components to be electrically connected. Thus, the structural elements can be connected together in a manner so as to create a circuit of the electronic components. In this regard, methods and casings for acting as electrical connections/data buses between internal components and methods for wireless communication between potted electronic communications through the potting to avoid the use of wiring in munitions are known (see U.S. Pat. Nos. 6,892,644; 7,118,825; 7,272,293; 8,110,784; 8,916,809 and 9,423,227).

Also discussed below, structural elements can be formed in a honeycomb array having integrally formed walls where each contains one or more electronic components that together form a particular circuit or plurality of circuits, including batteries (as discussed below) for powering such circuitry.

Regardless of configuration, the potting encasing the electronic components 152 would act as the non-compressible material 154 disposed in the interior cavity 162 of the structural element 150, thereby providing such electronic components 152 having high rigidity that adds to the high rigid mass of the kill vehicle. This is in contrast to current conventionally used electronic components/circuitry used in kill vehicles which reduce and compromise the total rigid mass of the kill vehicle.

Additionally, the encasing of the electronic components 152 adds to the ruggedness of the electronic components and prevents damage during handling and transportation of the kill vehicles and during/after firing due to the high-G load experienced during the firing acceleration and/or setback shock of the missile carrying the kill vehicle as well as resistance to jamming countermeasures.

Reference is now made to FIGS. 5-9 with respect to the first type of rigid mass components where a portion of the component is the non-compressible elastomer, gel or liquid in the interior cavity of the structural element, such as batteries, fuel and explosives.

Figure 5:
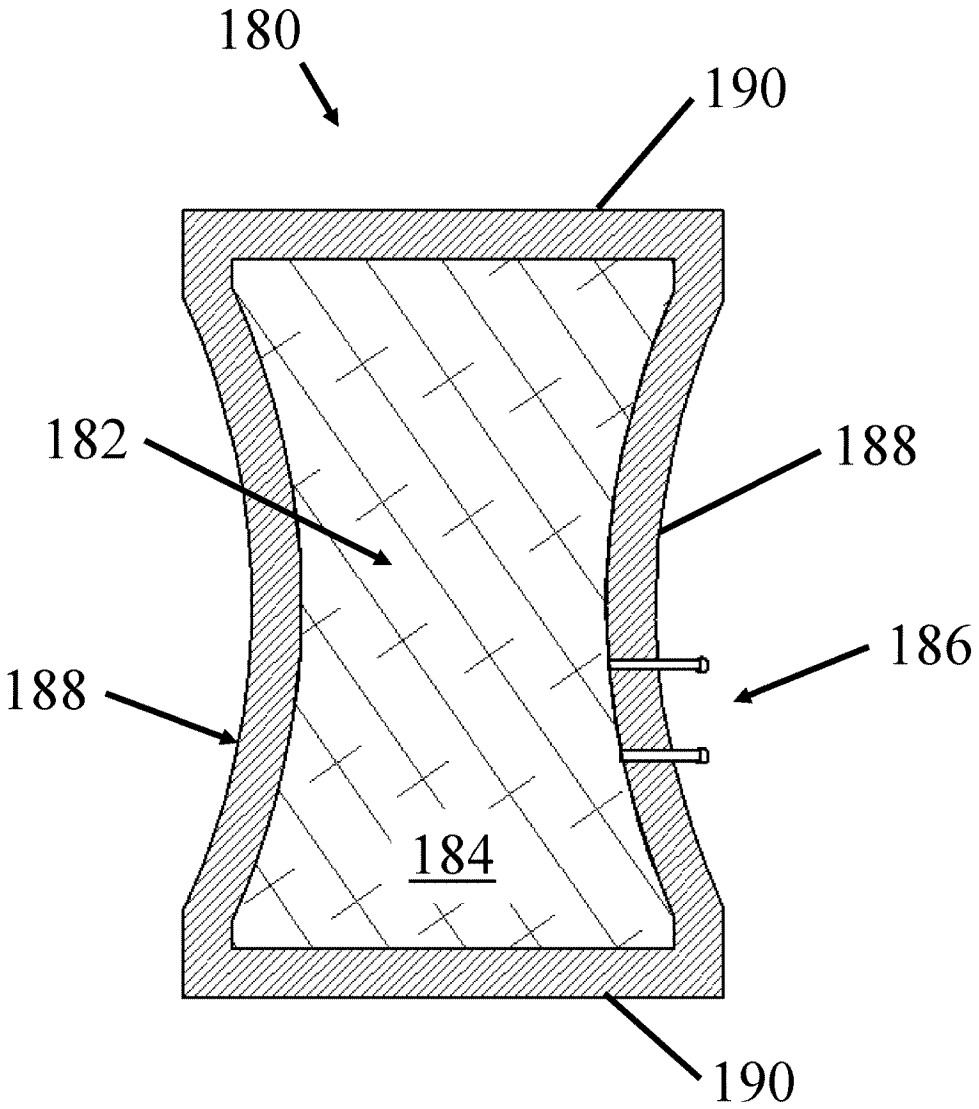
FIG. 5 illustrates a sectional view of a rigid mass component for a kill vehicle in the form of a battery.

Turning first to FIG. 5, the same illustrates a structural element 180 having materials 182 forming a battery disposed in the interior cavity 184. Such materials 182 can be solids, gels, liquids and any combination thereof and have an overall non-compressible or substantially non-compressible characteristic. Battery terminals 186 can be provided through any of the side 188 or top/bottom 190 walls to carry any produced power to electronic components carried in separate structural elements contained in the kill vehicle casing. Alternatively, as discussed above, the casing may act to carry such power to the separate structural elements contained in the kill vehicle casing.

The battery 180 can be of the type that is activated prior to use or by a firing acceleration of the missile carrying the kill vehicle, such as liquid reserve batteries. In such configuration, the interior cavity 184 of the structural element 180 can contain the battery cell and a liquid electrolyte can be contained in a housing outside of the interior cavity of the structural element. Methods and devices for forcing the liquid electrolyte into gaps dispersed to the battery cell contained in the interior cavity of the structural element, including heating the same as it is being forced into the battery cell are known (see U.S. Pat. Nos. 7,231,874; 7,437,995; 7,587,979; 7,587,980; 7,832,335; 8,042,469; 8,061,271; 8,183,746; 8,191,476; 8,245,641; 8,286,554; 8,418,617; 8,434,408; 8,479,652; 8,490,547; 8,550,001; 8,588,903; 8,651,022; 8,776,688; 8,841,567; 8,931,413; 9,057,592; 9,123,487; 9,160,009; 9,168,387; 9,252,433; 9,435,623 and 9,841,263).

After activation of the thermal battery, the combined battery cell and liquid electrolyte would act as the non-compressible material disposed in the interior cavity 184 of the structural element 180, thereby providing a battery having a high rigidity that adds to the high rigid mass of the kill vehicle. This is in contrast to current batteries or other power sources used in kill vehicles which reduce and compromise the total rigid mass of the kill vehicle.

Figure 6:
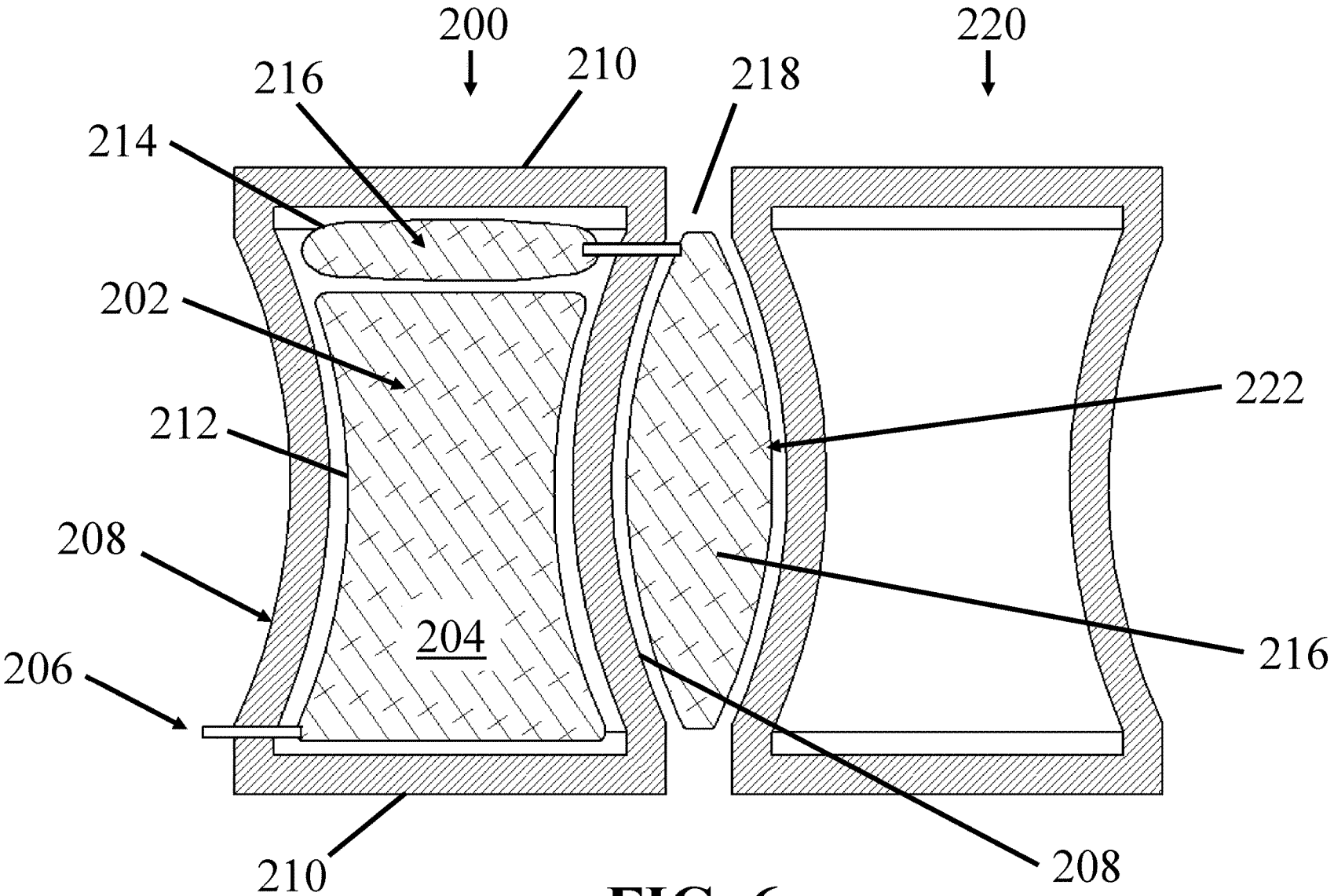
FIG. 6 illustrates a sectional view of a rigid mass component for a kill vehicle in the form of a fuel tank.

Turning next to FIG. 6, the same illustrates a structural element 200 having fuel 202 disposed in the interior cavity 204 for use with steering/propulsion actuators. Such fuel 202 may be limited to liquid fuel for use with the steering actuators and have an overall non-compressible or substantially non-compressible characteristic. An output fuel line 206 can be provided through any of the side 208 or top/bottom 210 walls to carry the fuel 202 to the actuators provided elsewhere in the kill vehicle casing, which, as discussed below, may be in separate structural elements contained in the kill vehicle casing.

A means is provided for pumping/forcing the fuel 202 from the interior cavity 204 to the steering actuators, such as a small pump. Furthermore, since the rigidity of the structural element 200 containing the fuel 202 is greatest where the cavity 204 is full of a non-compressible material, such fuel 202 can be provided from the cavity 204 and yet the cavity 204 is maintained full of non-compressible material. For example, the fuel can be contained in a first bladder 212 contained in a first portion of the interior cavity 204 and a second bladder 214 can be provided in a second portion of the cavity 204 which can fill and expand with another non-compressible liquid 216 as the first bladder 212 reduces in size upon the use of the fuel 202 such that both bladders 212, 214 together provide non-compressible material to fill the interior cavity 204 of the structural element 200.

The combination of fuel 202 and other non-compressible liquids 216 in the first and second bladders 212, 214 would together act as the non-compressible material disposed in the interior cavity 204 of the structural element 200, thereby providing a fuel supply container having a high rigidity that adds to the high rigid mass of the kill vehicle. This is in contrast to current fuel supply containers used in kill vehicles which reduce and compromise the total rigid mass of the kill vehicle.

As shown in FIG. 6, the other non-compressible material 216 can be supplied to the second bladder 214 from a third bladder 22 or other container disposed in spaces 218 not being used in the interior of the kill vehicle, such as those between adjacent structural elements 220. Furthermore, means can be provided to force the other non-compressible material 216 from the second bladder can be used to compress the first bladder 212 to force the fuel from the first bladder 212 to avoid the need for a separate pump. Alternatively, an actuator that presses the third bladder 222 can be used instead of a pump.

Types of fuel can be used that provide a balance between efficiency for actuation and highest non-compressibility. Further, the other non-compressible material can be optimally placed within the kill vehicle casing to provide a balance between taking advantage of space not being utilized and ease of pumping/forcing the other non-compressible material 214 into the second bladder 214 and/or pumping/forcing the fuel 202 from the first bladder 212.

Alternatively, as discussed below, the actuators can be of the type using solid propellant and contained in either separate structural elements or structural elements integrally formed in the casing of the kill vehicle.

Figure 7:
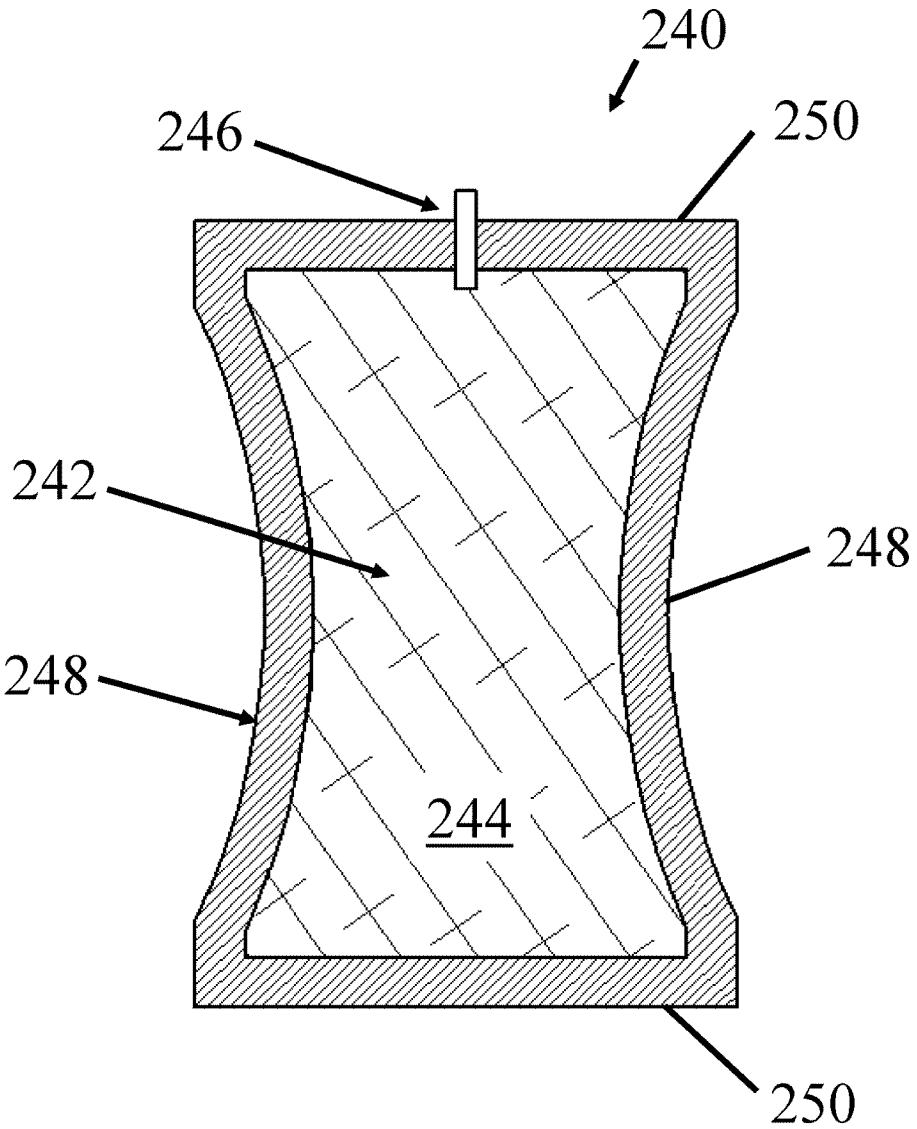
FIG. 7 illustrates a sectional view of a rigid mass component for a kill vehicle for holding explosive materials.

Turning next to FIG. 7, the same illustrates a structural element 240 having explosive material 242 disposed in the interior cavity 244 defined by the side 248 and top/bottom 250 walls. As discussed above, although the use of explosives in kill vehicles has been largely abandoned, small sized kill vehicles may utilize explosives to increase the likelihood that the threat target is neutralized where the impact alone from a small size kill vehicle is insufficient. Furthermore, as also discussed above, explosives did not previously provide the rigid mass that is necessary to neutralize a threat target. Therefore, structural elements filled with non-compressible explosive material 242 provides both an explosive material structure having high rigid mass and added destructive force for neutralizing a threat target.

A structural element 240 configured as such can have an arming or firing device 246 for igniting the explosive at impact. The types of explosives are chosen that provide a balance between greatest explosive force and highest non-compressibility. Further, the structural element 240 can be optimally placed within the kill vehicle casing to provide a balance between optimizing initiation and maximum damage to the threat target.

Upon impact with the threat target, the explosive 242 would act as the non-compressible material disposed in the interior cavity of the structural element, thereby not only providing high rigidity that adds to the high rigid mass of the kill vehicle but also adding the additional destructive force of the explosive 242. This is in contrast to explosives previously used in kill vehicles which reduce and compromise the total rigid mass of the kill vehicle.

Figure 8:
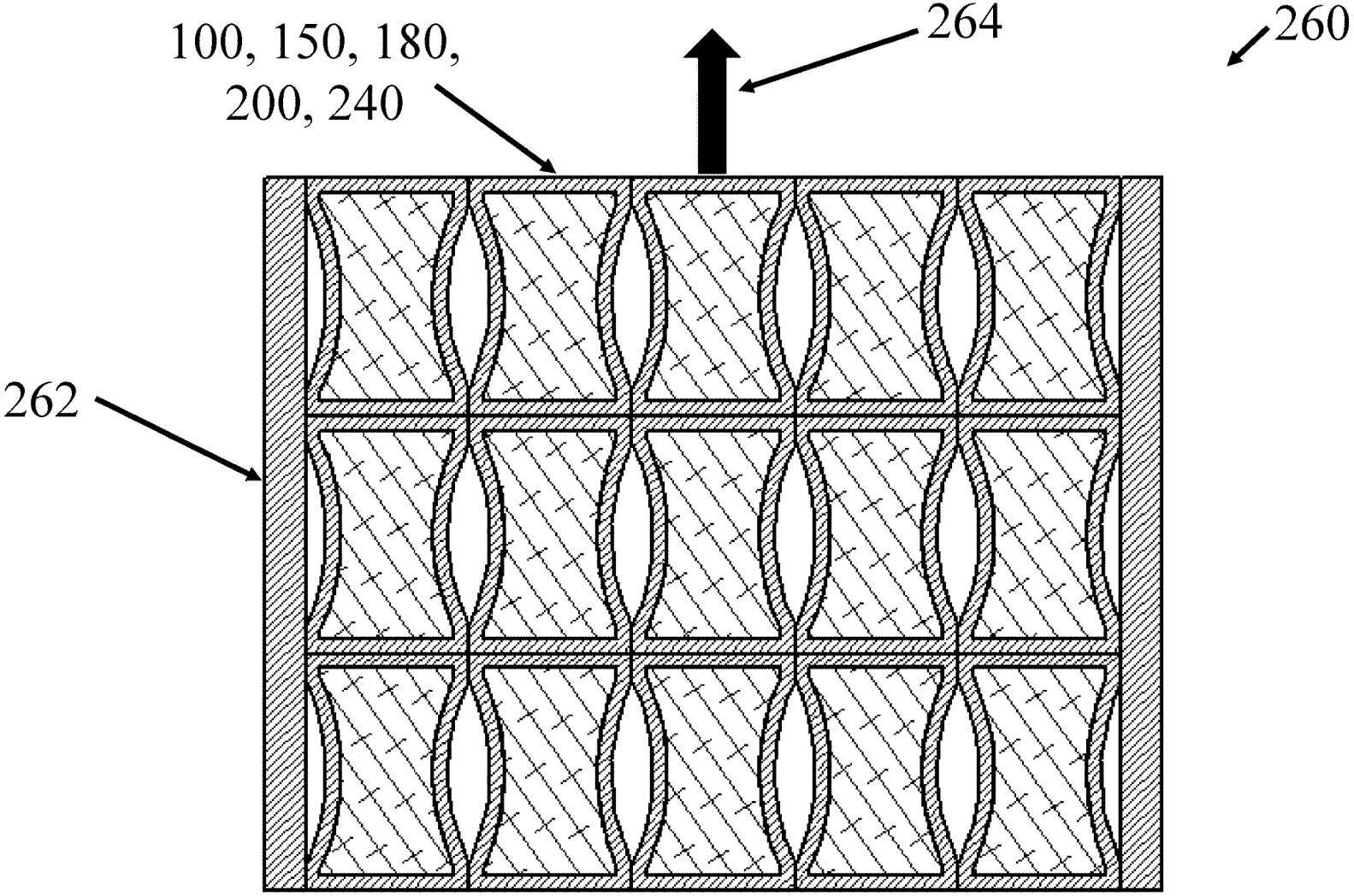
FIG. 8 illustrates a sectional view of a kill vehicle having rigid mass components disposed in a casing of the kill vehicle.
Figure 9:
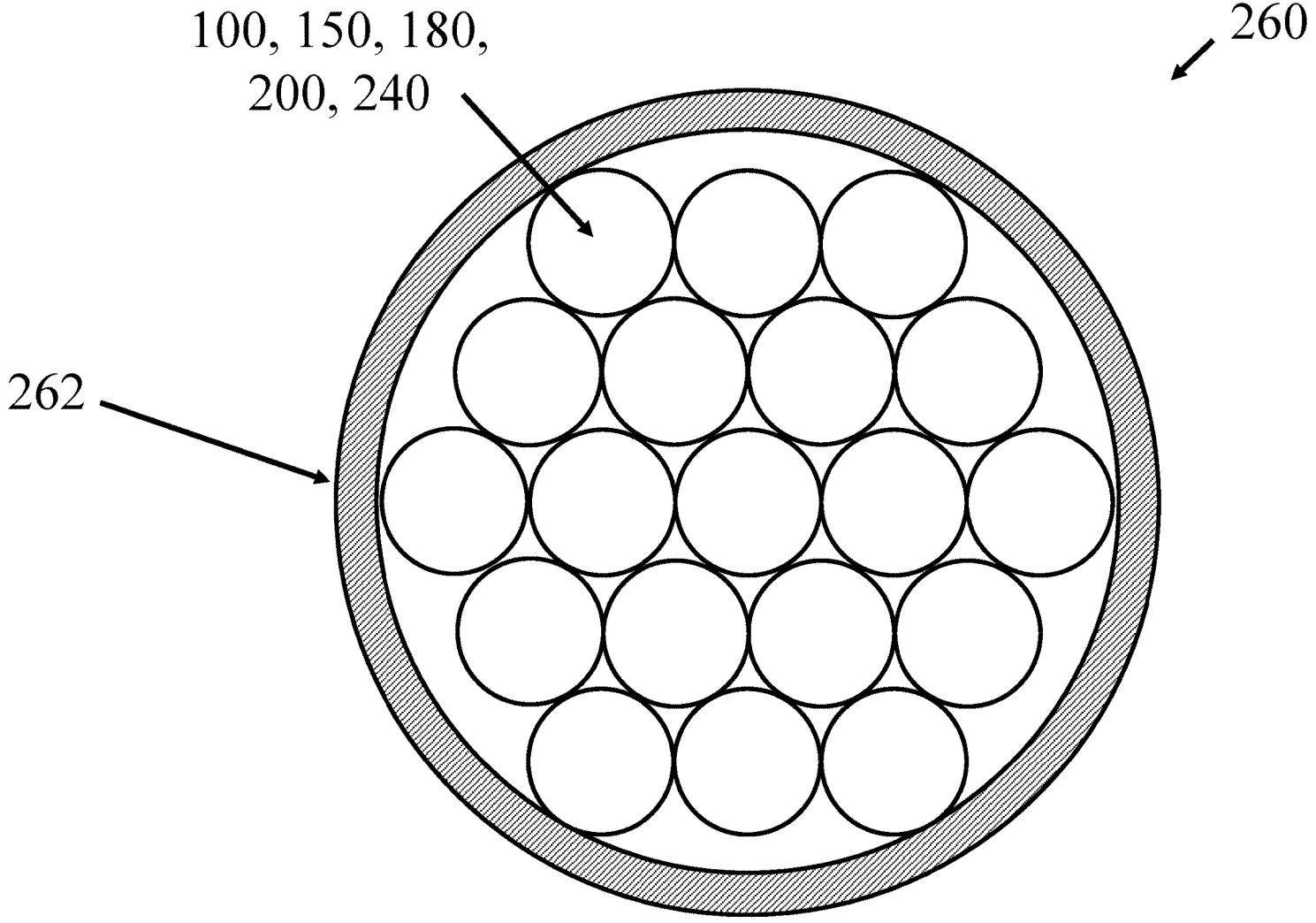
FIG. 9 illustrates a top view of the kill vehicle of FIG. 8.

Turning next to FIGS. 8 and 9, the same illustrate a possible orientation of the above structural elements 100, 150, 180, 200, 240 in a casing 262 of a kill vehicle 260 or portion thereof. Although the kill vehicle 260 may contain one or more of the structural elements 150, 180, 200, 240 of FIGS. 4-7, the base structural element 100 of FIGS. 1-3 may also be disposed in the kill vehicle casing 262. Such base structural elements 100 may be used to fill spaces where other structural elements 150, 180, 200, 240 are not being used or used to fill the entire interior of the kill vehicle casing 262. Likewise, although a variety of the structural elements 150, 180, 200, 240 of FIGS. 4-7 may be used in the kill vehicle casing 262, any of the structural elements 150, 180, 200, 240 can be used to fill the entire kill vehicle casing 262, such as the kill vehicle casing being entirely filled with structural element 240.

FIG. 8 shows a sectional view of the kill vehicle casing 262 having an array of structural elements 100, 150, 180, 200, 240 stacked in the casing 262 wherein the structural elements 100, 150, 180, 200, 240 are oriented in a direction such that their greatest rigidity is in the direction of travel 264 of the kill vehicle 260. As discussed above, any structural elements 150 having electronic components are arranged to form a circuit or to perform a particular function and are electrically connected to each other through wiring or other means (such as use of the casing as a wiring/data transfer bus). Structural elements 180 providing power to such electronic components, circuitry can also be provided in the casing 262. FIG. 9 is a sectional view of FIG. 8 and illustrates an orientation of the structural elements 100, 150, 180, 200, 240 in a radial plane of the kill vehicle 260. FIG. 9 illustrates that the structural elements 100, 150, 180, 200, 240 can be arranged so as to minimize any empty space between structural elements 100, 150, 180, 200, 240 (however, as discussed above, such space can be used to accommodate other components/materials). The structural elements can be arranged to achieve a balance between optimum function of the components formed by the structural elements and maximum rigidity in the direction of the kill vehicle travel.

Alternatively, as discussed below, the empty spaces can be minimized by forming the structural elements in a honeycomb where all/some of the walls are integrally formed. Also as discussed below, the walls of the casing can itself be formed as a structural element having a high rigidity and may also house any of the components discussed above and/or other components, such as actuators.

Figure 10:
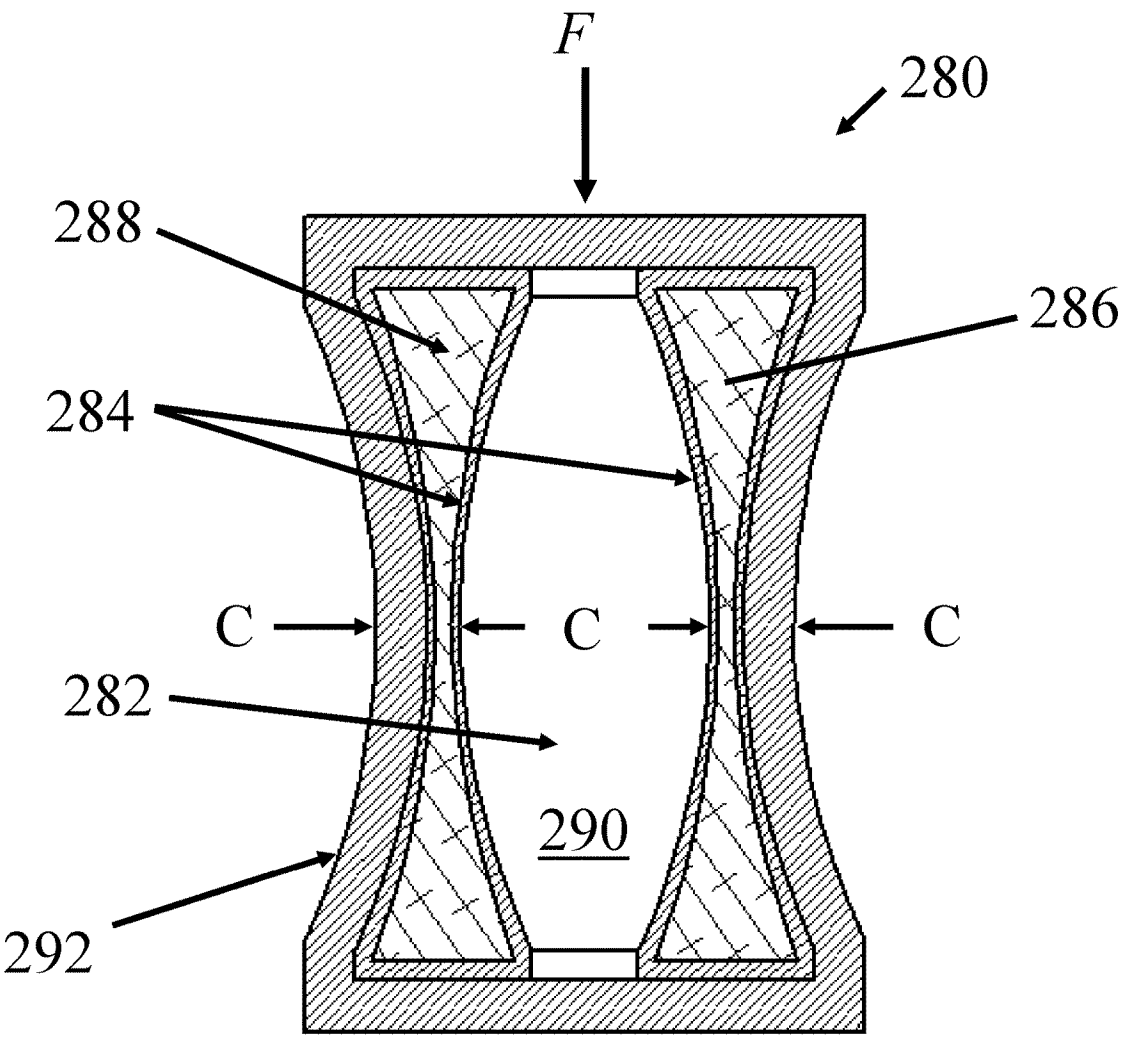
FIG. 10 illustrates a sectional view of a rigid mass component for a kill vehicle having an empty inner cavity.
Figure 11:
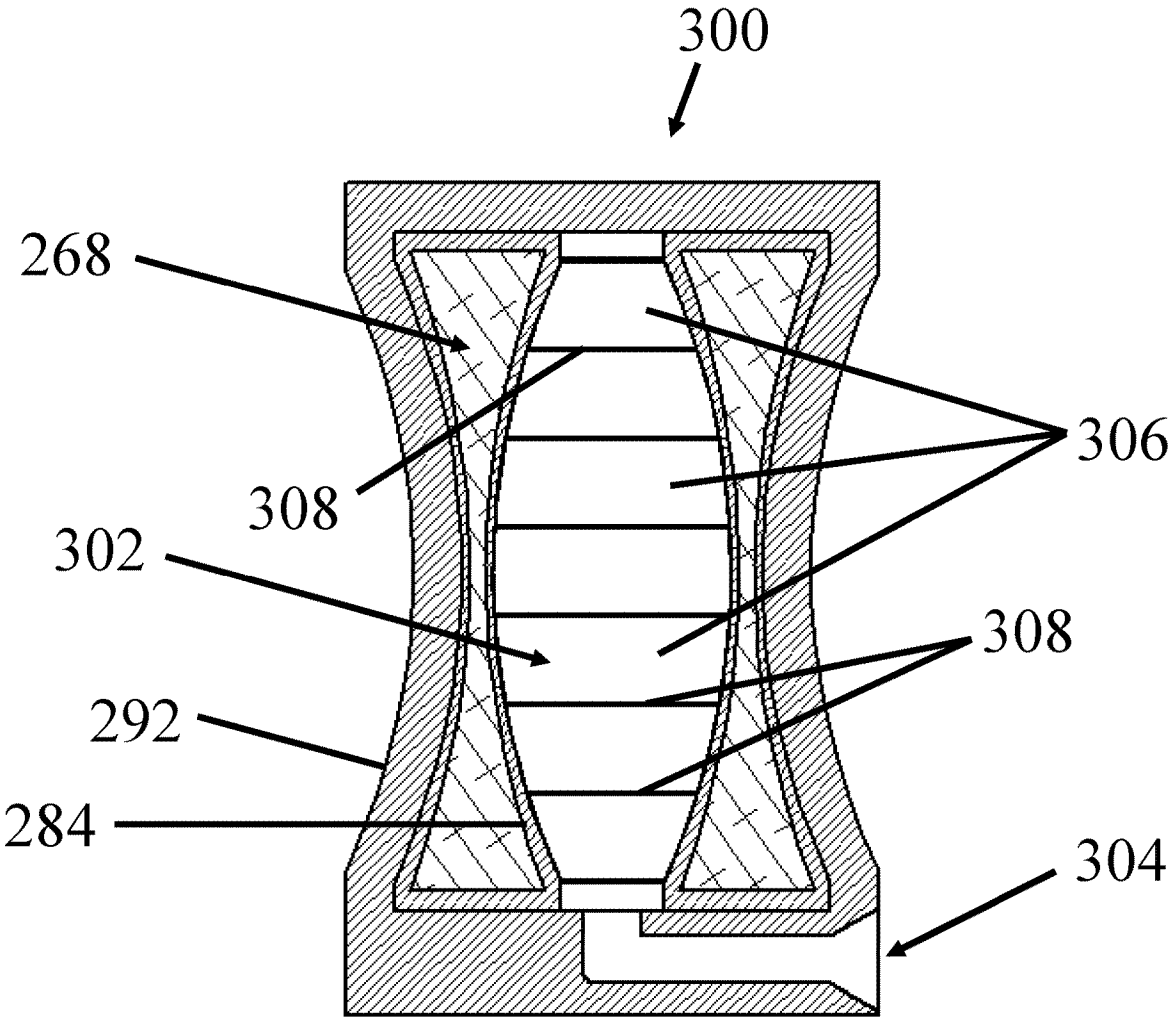
FIG. 11 illustrates a sectional view of a rigid mass component for a kill vehicle in the form of an actuator stack provided in the empty inner cavity.
Figure 12:
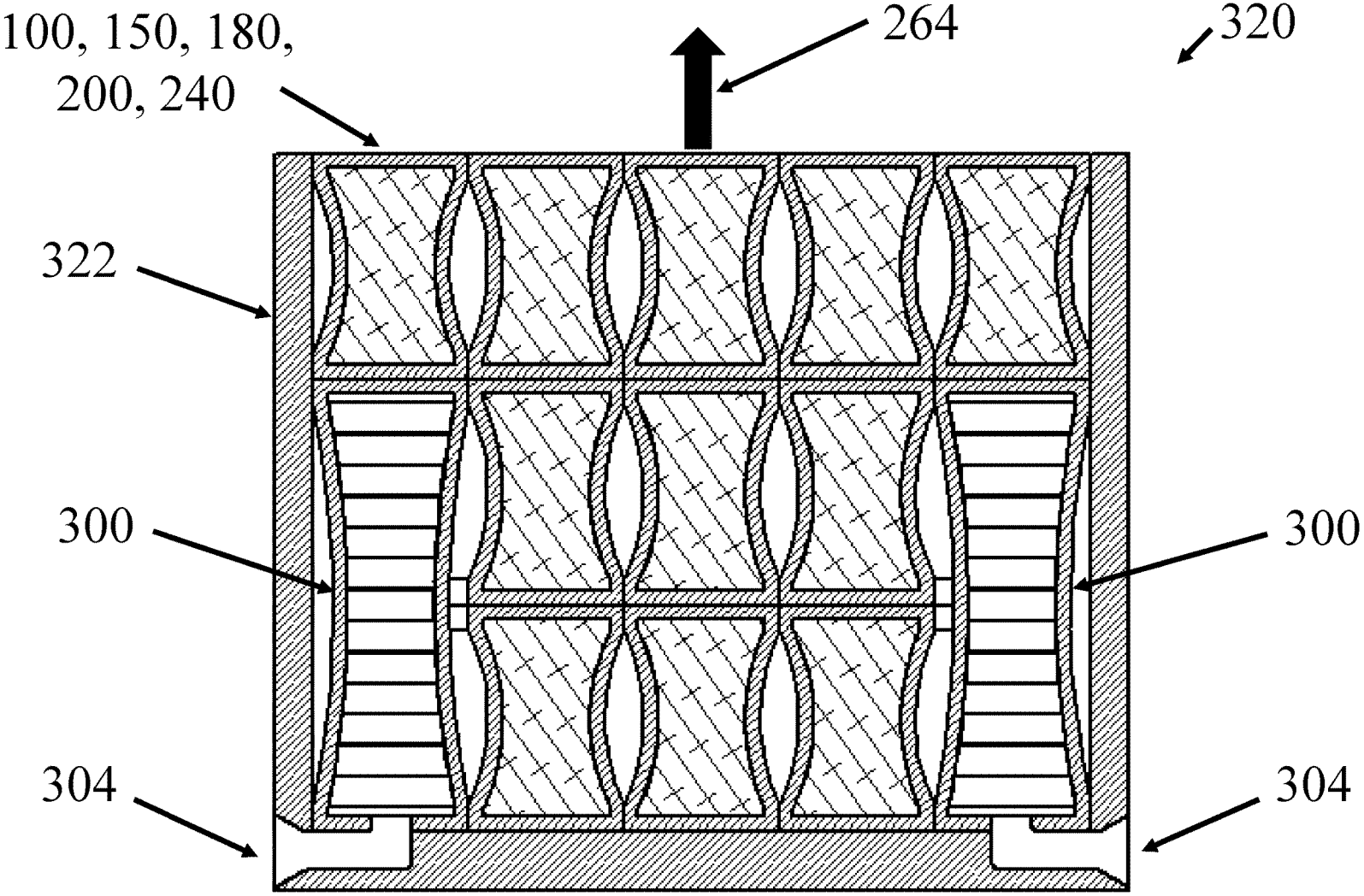
FIG. 12 illustrates a sectional view of a kill vehicle having rigid mass components and actuator stacks disposed in a casing of the kill vehicle.

Referring now to FIGS. 10-12, a first variation of structural element will now be described where the structural element is modified so as to have an empty internal volume that can be occupied by a kill vehicle component, such as steering actuators.

Figure 1:
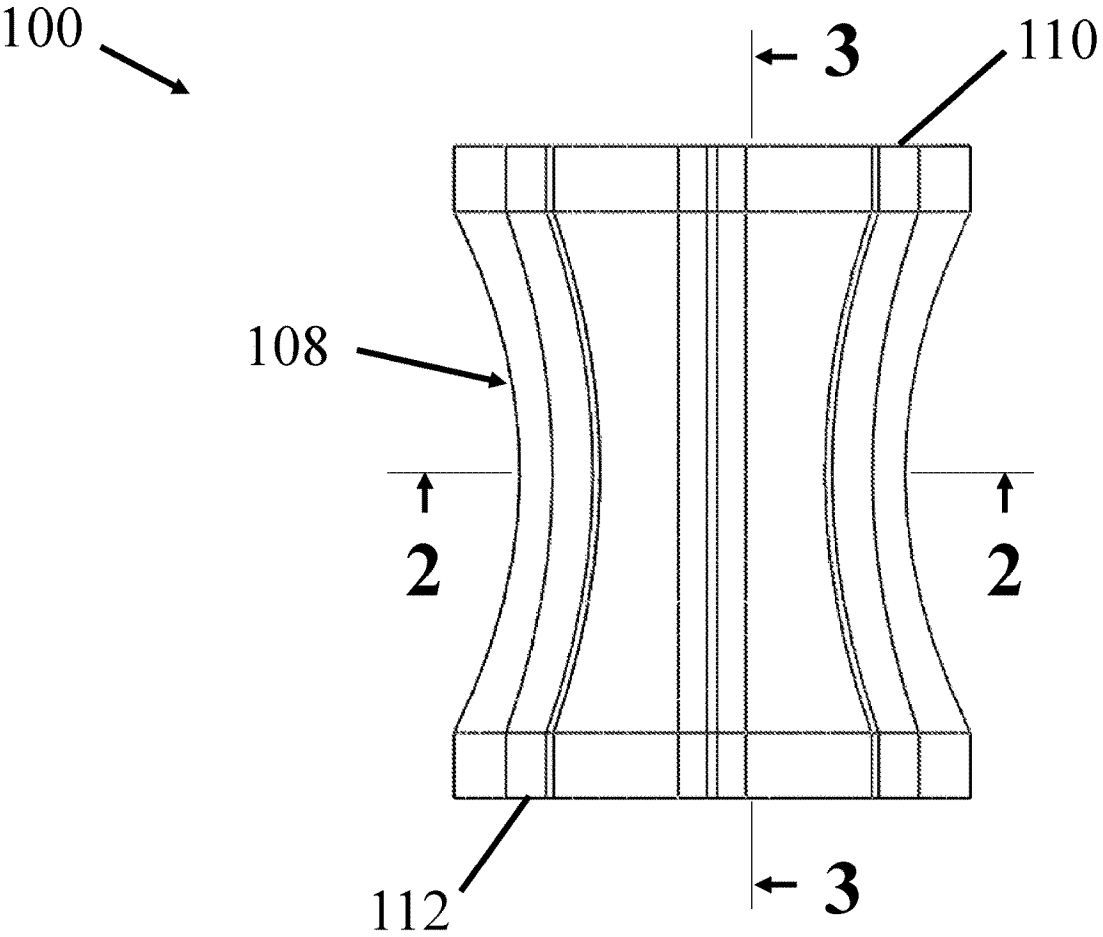
FIG. 1 (Prior Art)
FIGS. 1-3 illustrate a structural element of the prior art, where
Figure 2:
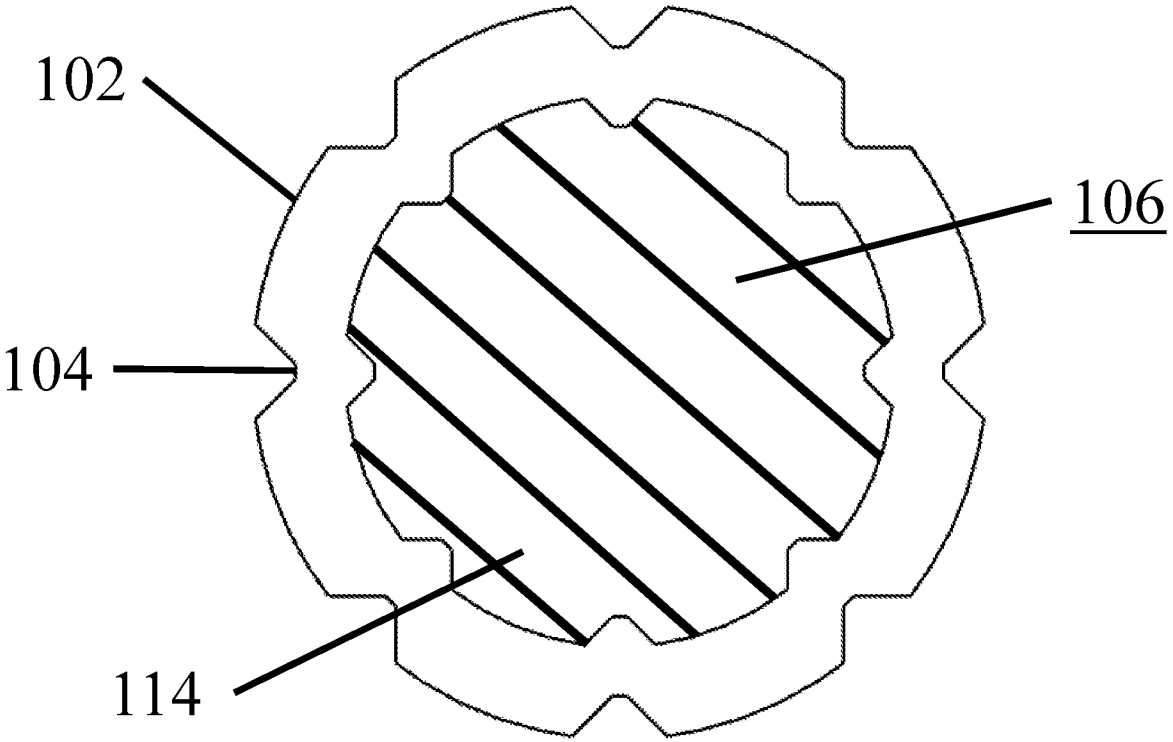
FIG. 2 (Prior Art)
Figure 3:
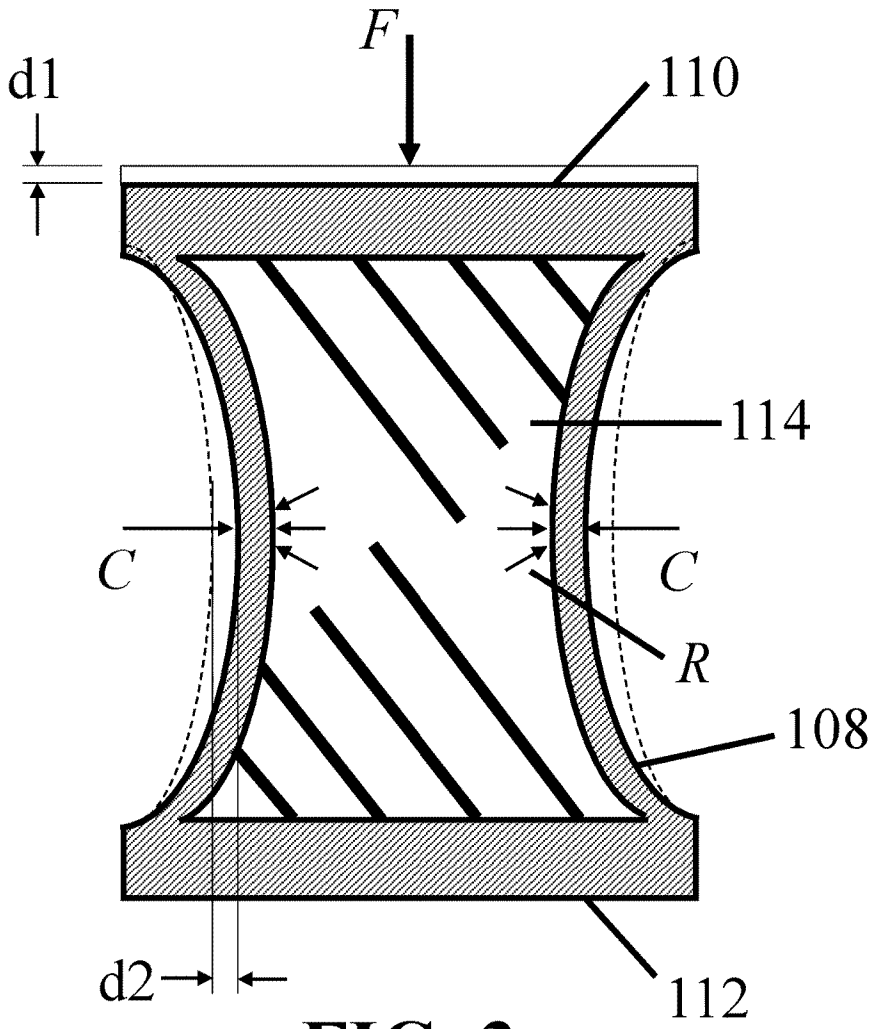
FIG. 3 (Prior Art)

Turning next to FIG. 10, the same illustrates a modification of the structural element 100 illustrated in FIGS. 1-3. In such modification, the structural element 280 includes an empty central cavity space 282 is added to the structural elements of FIGS. 1-3 by adding inner walls 284. The inner walls 284 are curved such that another cavity 286, having an annular shape is formed. The non-compressible material 288 is disposed in such other annular shaped cavity 286. In the configuration of the modified structural element 280, the inner wall 284 is a barrel shaped cylindrical wall defining a barrel shaped empty space 290. The modified structural element operates similarly to those described above with regard to FIGS. 1-3. That is, a compressive force F applied to the structural element 280 causes an amplified deflection of the outer wall 292 and inner wall 284 into the non-compressible material 286 to resist the compressive force C and the applied force F. However, in such modified configuration, the empty space 290, which can be cylindrical, can be utilized to contain a component of the kill vehicle that would not typically add to the rigid mass of the kill vehicle.

Any of the components discussed above, such as batteries, electronics, fuel and explosives can be used in the empty space. In addition, as shown in FIG. 11, the empty space 290 of the structural element 300 can be used to house an actuator stack 302 for providing steering capabilities with the addition of an exhaust nozzle 304 added to the structural element 300. Such exhaust nozzle 302 can be oriented in any direction to achieve the desired thrust direction. Structural elements having the actuator stack can be provided with exhaust nozzles in more than one direction to provide steering capability in any direction, including left/right/forward/backward thrust directions.

Actuator stacks that can be utilized in the empty space of the modified structural element of FIG. 10 are known in the art. In such nozzle type thrusters, several layers of propellants 306 are packaged in a single thruster and separated by protective layers 308 to avoid sympathetic ignition and to allow the individual shots to be ignited electrically at any desired time (see U.S. Pat. Nos. 7,800,031; 7,975,468; 7,973,269; 7,973,270 and 9,151,581).

As shown in FIG. 12, the structural elements 300 configured with the actuators can be disposed in the casing 322 of the kill vehicle 320 or portion thereof in an orientation such that maximum rigidity is in the direction of travel 264 of the kill vehicle 320 along with other structural elements 100, 150, 180, 200, 240, such as those described above containing other kill vehicle components. Alternatively, as discussed below, the modified structural elements, such as those containing the actuators, can be integrated in a wall of the kill vehicle casing.

Figure 13:
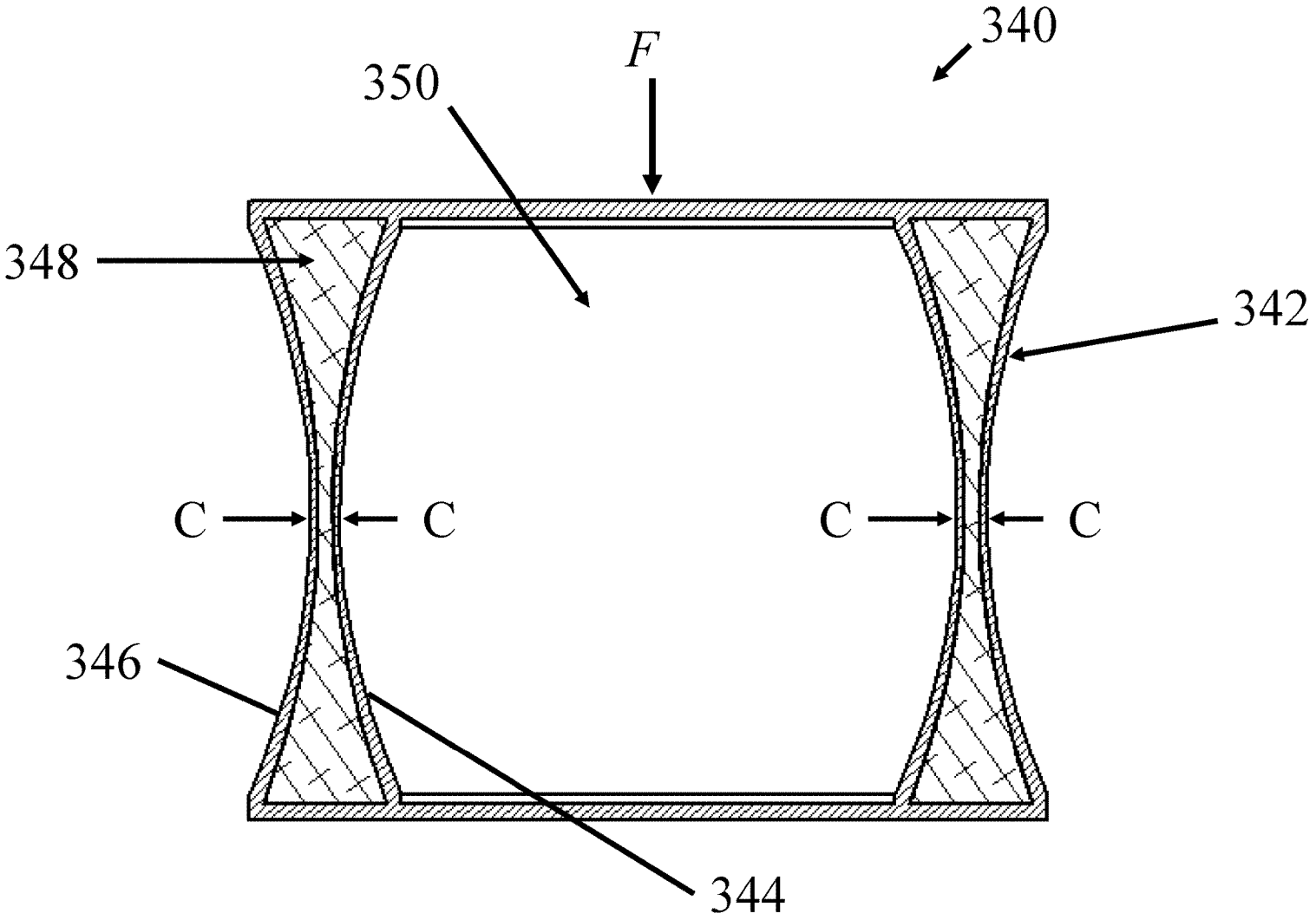
FIG. 13 illustrates a sectional view of a kill vehicle having a casing comprising rigid mass components.

Embodiments will now be described for increasing the rigidity of the casing of the kill vehicle itself. That is, the entire casing or a portion of the casing of the kill vehicle can be formed of the modified structural element 280 discussed above with regard to FIG. 10. As shown in FIG. 13, a kill vehicle 340 can have a casing 342 in which the inner 344 and outer 346 walls of the casing are formed to have the non-compressible material 348 and to define the central empty cavity 350. As so configured, the casing 342 will have high specific strength and high specific modulus with the empty inside space 350 that can be used to house components that do not typically have a high rigidity or to house components, such as those discussed above that make use the novel structural elements to add rigidity to those components that typically do not possess the same. A small sized kill vehicle having both a casing and internal components with high rigidity and low weight can boast of having very high specific modulus and very high specific strength to increase the likelihood of neutralizing a threat target by impact alone.

Figure 14:
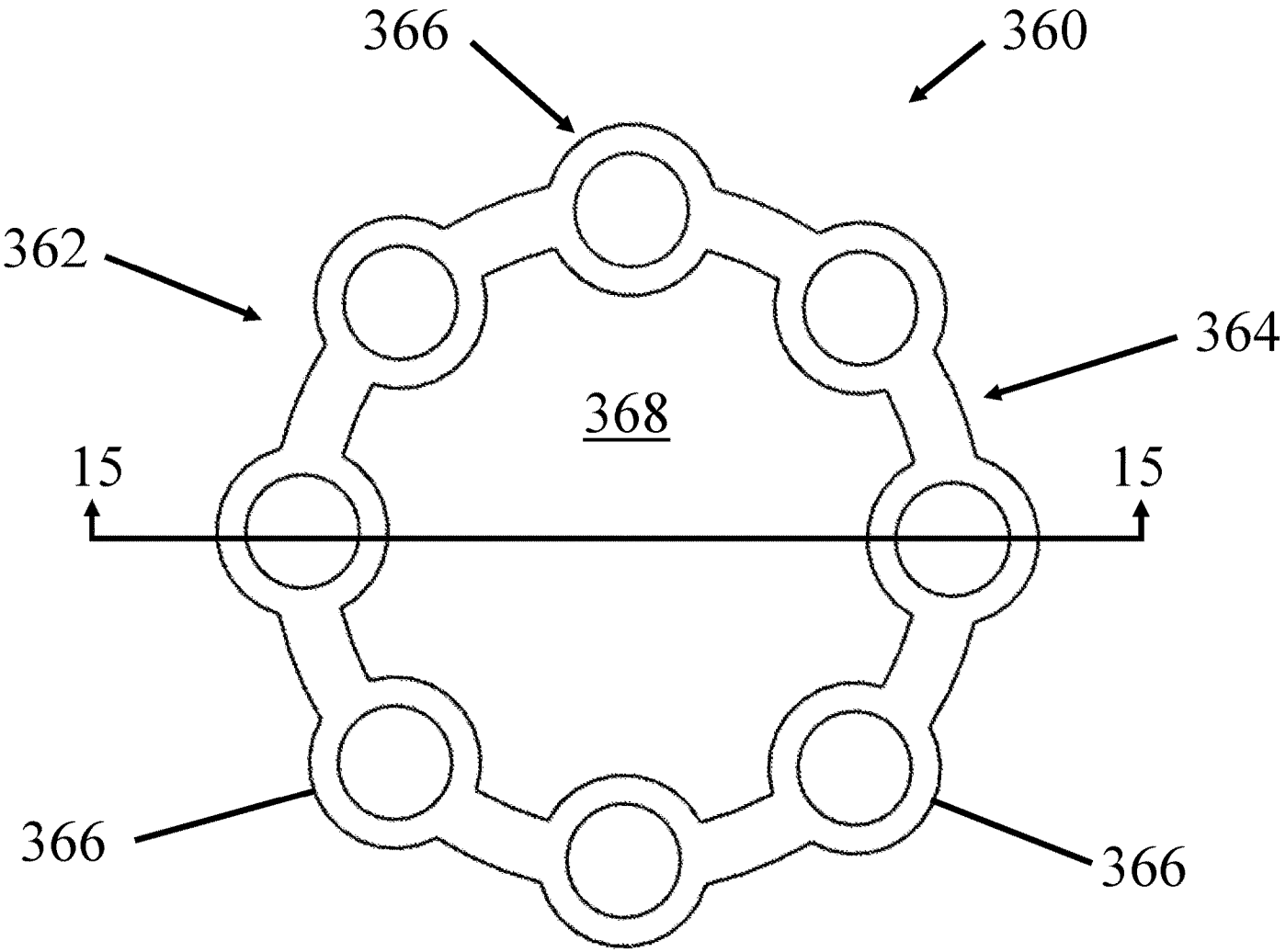
FIG. 14 illustrates a top view of a kill vehicle having rigid mass components in the form of actuator stacks disposed in a casing of the kill vehicle.

Referring now to FIG. 14, alternatively, the casing wall 362 of the kill vehicle 360 can be formed to integrate any of the components described above, in particular, the steering actuators. FIG. 14 illustrates a sectional view of a kill vehicle casing having alternating sections of casing wall 364 and steering actuators 366 integrated into the casing wall 362. As discussed above, the central empty space 368 in the casing can be used to house components that do not typically have a high rigidity or to house components, such as those discussed above, that make use of the structural elements to add rigidity to those components that typically do not possess the same.

Figure 15A:
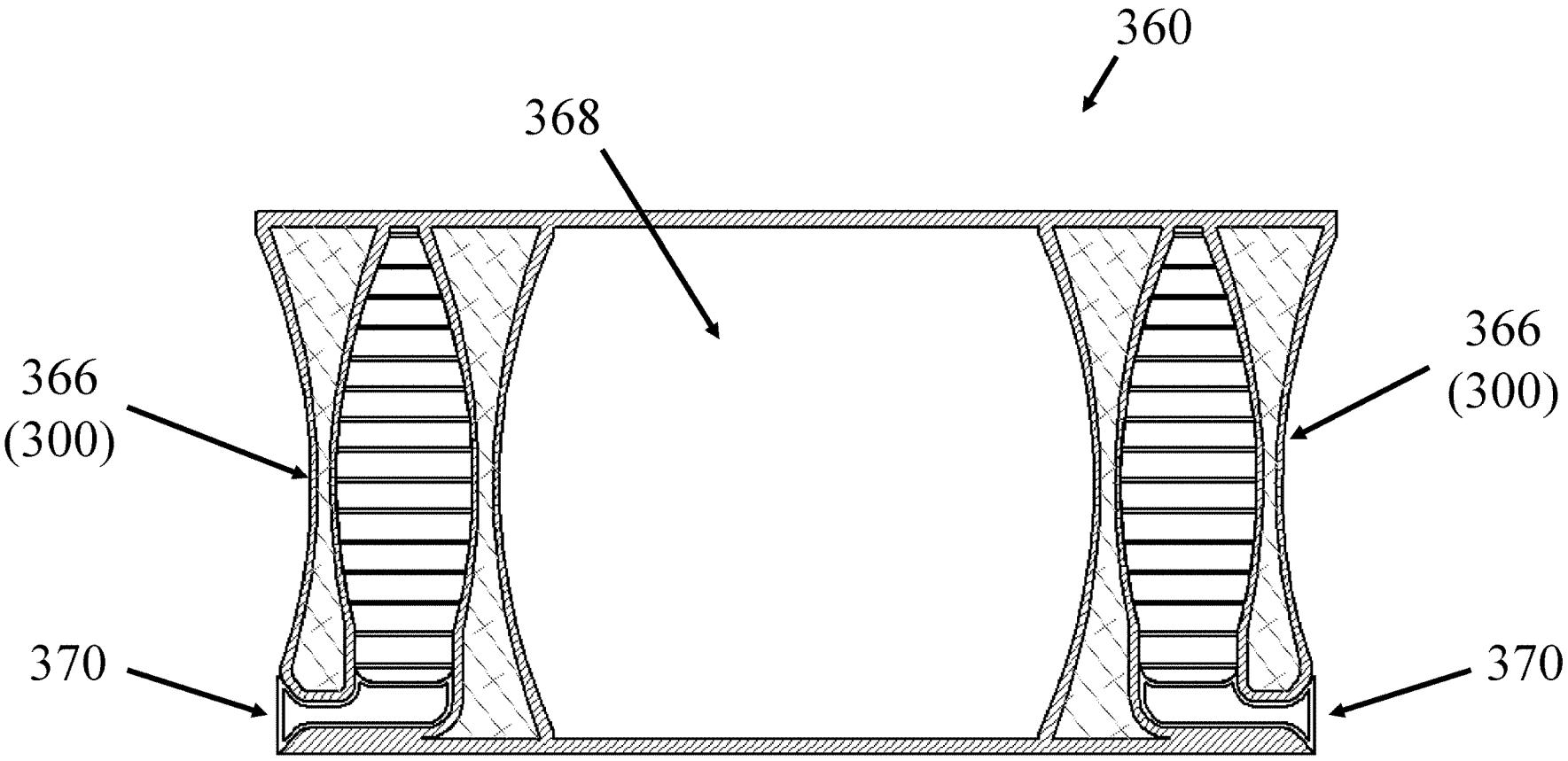
FIG. 15*a* illustrates a sectional view of the kill vehicle of FIG. 14 as taken along line 15-15 in FIG. 14.
Figure 15B:
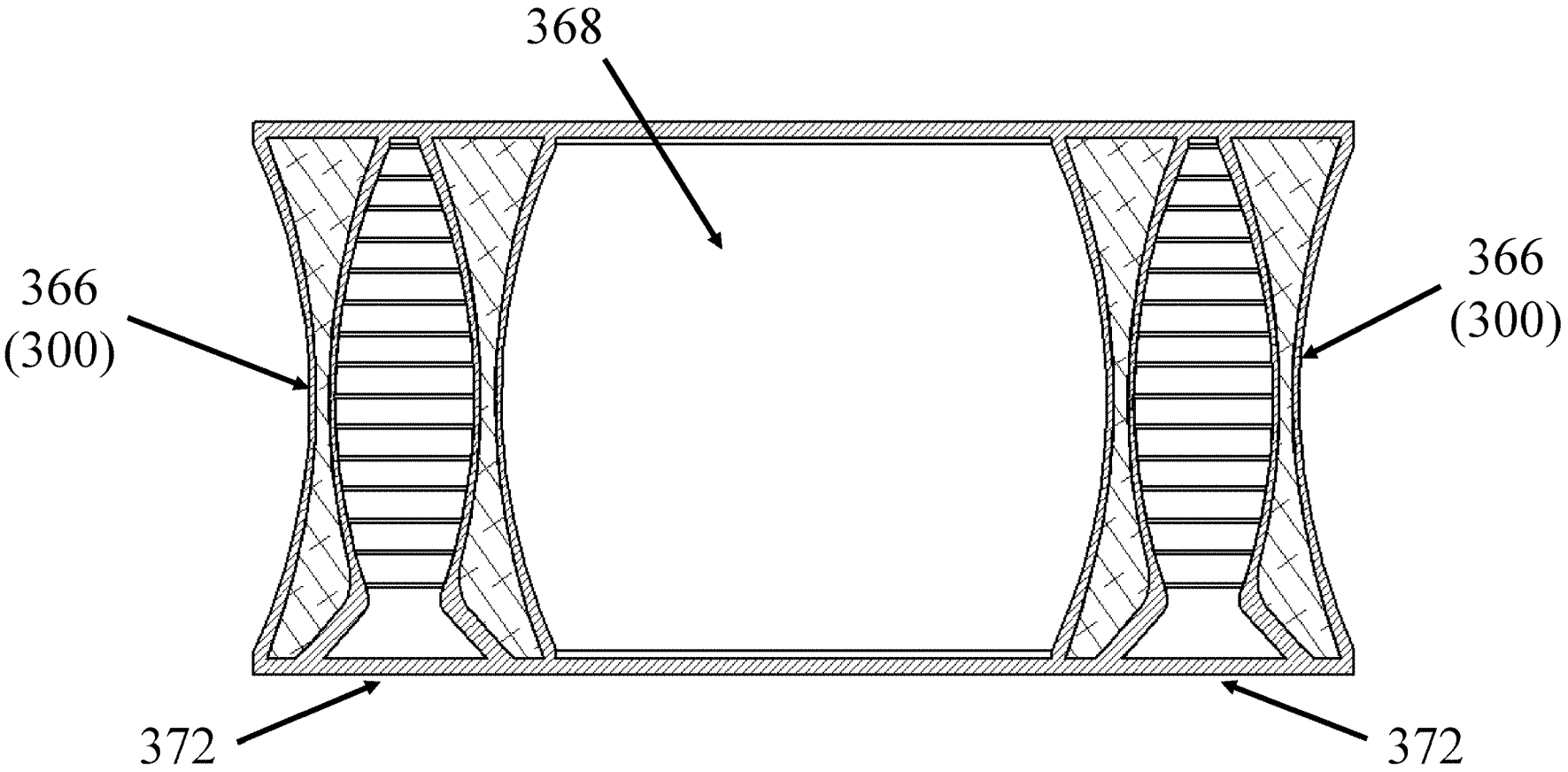
FIG. 15*b* illustrates a sectional view of a modification of the kill vehicle of FIG. 14 as taken along line 15-15 in FIG. 14.

The sections 364 of casing wall in FIG. 14 can be as shown in FIGS. 8 and 12, that is, to have a conventional wall. Alternatively, such sections can be formed as shown in FIG. 13 as a structural element having high rigidity. The other sections 366, can be configured as the modified structural element 280 as shown in FIG. 10 so as to house any of the components discussed above, in particular, steerable actuators as shown in the sectional view of FIGS. 15*a* and/or 15*b* as taken along line 15-15 in FIG. 14. FIGS. 15*a* and 15*b*, illustrate the casing wall having alternating sections 366 of steerable actuators (similar to structural element 300) having either sideways 370 or rearward 372 facing exhaust nozzles. Actuators having such sideways and rearward facing nozzles may each be provided in the casing wall.

Figure 16:
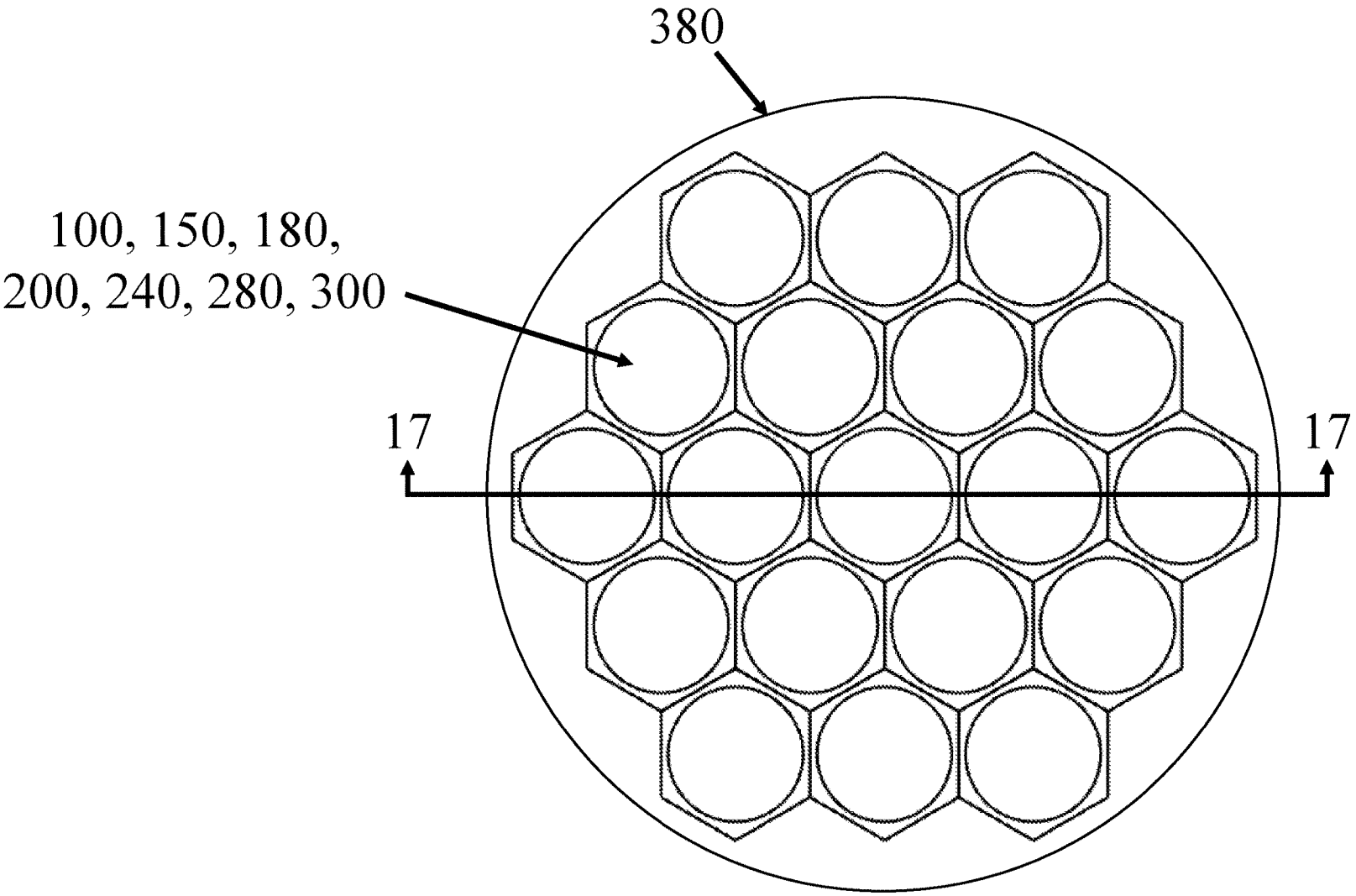
FIG. 16 illustrates a sectional view of a rigid mass component for a kill vehicle in the form of a honeycomb plate.
Figure 17:
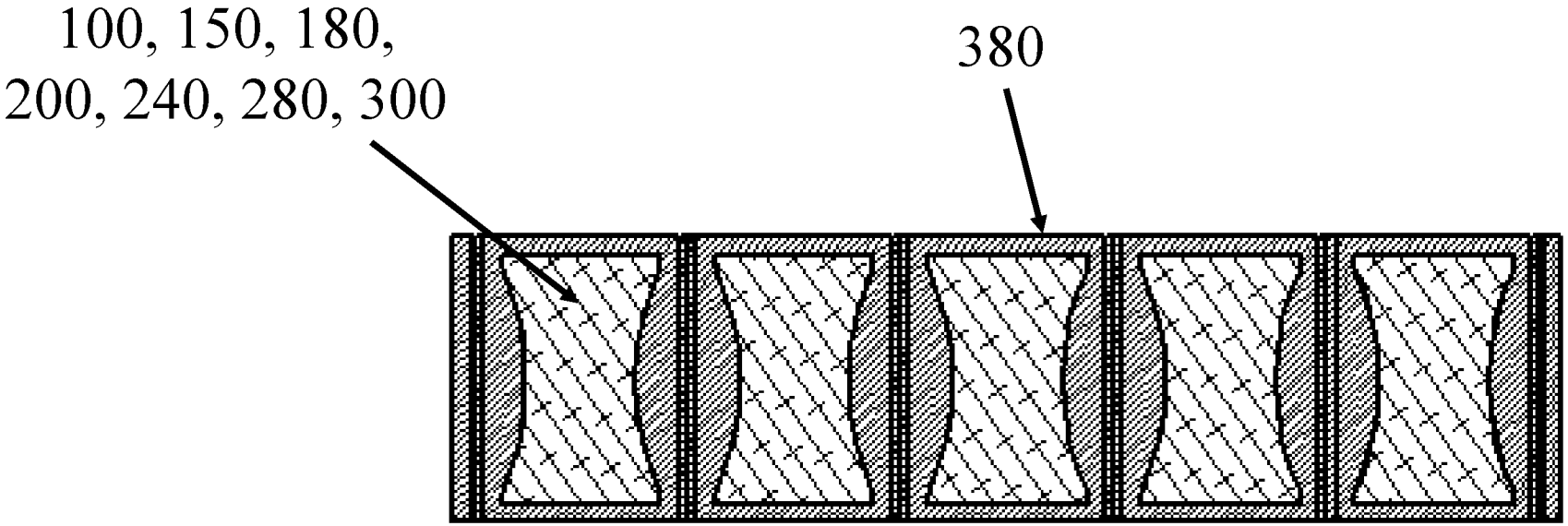
FIG. 17 illustrates a sectional view of the honeycomb plate of FIG. 16 as taken along line 17-17 in FIG. 16.

Referring now to FIGS. 16 and 17, the same illustrate the structural elements 100, 150, 180, 200, 240, 280, 300 having any of the configurations discussed above arranged in a honeycomb plate 380. In such honeycomb plate 380, at least some of the walls of the structural elements (see FIGS. 2 and 10) can be formed integrally in the honeycomb.

Such honeycomb plates 380 can be stacked inside the empty space in the casing of the kill vehicle. For Example, a single honeycomb plate may have an outer diameter that fits tightly in the inner diameter of the kill vehicle casing and the combination of the structural elements in such plate may together form a complete electrical circuit, while other complete plates may house fuel, explosives and/or batteries. Although the structural elements in the honeycomb plates can contain any of the components discussed above, some structural elements in the honeycomb may be configured as "dummy" structural elements solely for adding rigidity. Furthermore, some spaces in the honeycomb may be empty such that other components may take up such space, such as wiring. Furthermore, the empty spaces in each honeycomb may correspond with empty spaces in adjacent stacked honeycomb plates to form a larger space for other components, such as actuator stacks.

The second type of "rigid class components" for use in a kill vehicle are intended to increase a frontal area of a kill vehicle in order to not only increase a likelihood of impact with the threat target but to increase a likelihood of neutralizing the threat target. Such second type of "rigid mass components" can address both increasing the likelihood of impact and destruction of the threat target by not only increasing a frontal impact area of the kill vehicle, but doing so in a rigid manner and in a direction of travel/impact of the kill vehicle.

Such second type of rigid mass components can increase the frontal area of the kill vehicle with structural elements deployed from within the kill vehicle casing where the maximum rigidity is in a direction of travel/impact of the kill vehicle. Such structural elements can house one or more of the components discussed above, such as explosives, or may be configured as "dummy" structural elements solely for adding rigidity in the additional frontal area.

Mechanical mechanisms can be used to deploy the structural element components in the frontal area of the kill vehicle where any additional components needed to deploy the structural elements have a minimal effect on the overall rigid mass of the kill vehicle.

Although the embodiments discussed above is particularly well suited to providing high specific modulus and high specific strength components for use in missile interceptors and kill vehicles (referred to only by way of kill vehicles above but equally applicable to missile interceptors), they also have utility for honeycomb structural components for commercial aircraft, missiles and satellites.

The structural element embodiments described above have widespread use in honeycomb structural components for commercial aircraft, missiles and satellites. Among such uses, the structural components have particular utility for use in satellites. Satellite components require high specific modulus and high specific strength to endure the high G's encountered during launch. Any savings in weight without sacrifice in strength is extremely important for commercial satellites which have significant costs per pound of payload put into earth orbit. In addition, satellites operate for as long as they have fuel. However, as discussed above, fuel, not only adds to the weight of the satellite, but does so in a non-rigid mass manner. As discussed above, the structural components described above can provide fuel in a rigid mass manner so as to endure the rigors of launch. In addition, the fuel is used over time and after the time when the rigidity is no longer needed (after launch).

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A kill vehicle comprising:

a casing having one or more structural elements disposed in the casing, each of the one or more structural elements comprising:

an enclosure having a top and bottom and an outer wall defining a cavity; and a non-compressible material disposed in the cavity;

wherein the outer wall has at least a portion thereof inwardly shaped toward the cavity such that a first compressive force acting on the top and/or bottom tending to compress the element by a first deflection causes an amplified second deflection, relative to the first deflection, of the outer wall into the non-compressible material, thereby exerting a second compressive force against the non-compressible material, resulting in a resistance to the first deflection and the first compressive force tending to compress the element.

2. The kill vehicle of claim 1, further comprising one or more electronic components disposed in the cavity.

3. The kill vehicle of claim 2, further comprising one or more leads connected to the one or more electronic components and exposed on an exterior of one or more of the top, the bottom and the outer wall.

4. The kill vehicle of claim 1, wherein at least a portion of the non-compressible material is a battery material for producing electrical power.

5. The kill vehicle of claim 4, further comprising one or more terminals connected to the battery material and exposed on an exterior of one or more of the top, the bottom and the outer wall.

6. The kill vehicle of claim 1, wherein at least a portion of the non-compressible material is a combustible fuel.

7. The kill vehicle of claim 6, further comprising:

a first bladder disposed in a portion of the cavity, the first bladder containing the fuel; and a second bladder disposed in other portions of the cavity, the second bladder containing another non-compressible material;

wherein, as the fuel is used, the first bladder being configured to decrease in volume and the second bladder being configured to increase in volume to fill the cavity together with the first bladder.

8. The kill vehicle of claim 1, wherein at least a portion of the non-compressible material is an explosive.

9. The kill vehicle of claim 8, further comprising one or more arming devices operatively connected to arm the explosive, the one or more arming devices being exposed on an exterior of one or more of the top, the bottom and the outer wall.

10. A kill vehicle comprising:

a casing, the casing having a wall having one or more structural elements formed in the wall, each of the one or more structural elements comprising:

an enclosure having a top, a bottom, and inner wall and an outer wall, a first cavity of defined between the inner and outer walls and a second cavity of defined by the inner wall; and a non-compressible material disposed in the first cavity; wherein the outer wall has at least a portion thereof inwardly shaped toward the first cavity and the inner wall has at least a portion outwardly shaped towards the first cavity such that a first compressive force acting on the top and/or bottom tending to compress the element by a first deflection causes an amplified second deflection, relative to the first deflection, of the inner and/or outer walls into the non-compressible material, thereby exerting a second compressive force against the non-compressible material, resulting in a resistance to the first deflection and the first compressive force tending to compress the element.

11. A kill vehicle comprising:

a casing, the casing having a wall having one or more actuators formed in the wall, each of the one or more actuators comprising:

an enclosure having a top, a bottom, and inner wall and an outer wall, a first cavity of defined between the inner and outer walls and a second cavity of defined by the inner wall;

a non-compressible material disposed in the first cavity;

an actuator disposed in the second cavity, the actuator having one or more layers of propellant; and a nozzle in communication with the actuator;

wherein the outer wall has at least a portion thereof inwardly shaped toward the first cavity and the inner wall has at least a portion outwardly shaped towards the first cavity such that a first compressive force acting on the top and/or bottom tending to compress the element by a first deflection causes an amplified second deflection, relative to the first deflection, of the inner and/or outer walls into the non-compressible material, thereby exerting a second compressive force against the non-compressible material, resulting in a resistance to the first deflection and the first compressive force tending to compress the element.

* * * * *